US008913902B2

(12) United States Patent
Spink

(10) Patent No.: US 8,913,902 B2
(45) Date of Patent: Dec. 16, 2014

(54) SYSTEMS AND METHODS FOR GENERATING AND DETECTING UNIQUE IDENTIFICATION SIGNATURES FOR CUSTOMER REPLACEABLE UNITS IN IMAGE FORMING DEVICES

(75) Inventor: Timothy Spink, Welwyn (GB)

(73) Assignee: Xerox Corporation, Norwalk, CT (US)

( * ) Notice: Subject to any disclaimer, the term of this patent is extended or adjusted under 35 U.S.C. 154(b) by 174 days.

(21) Appl. No.: 13/592,488

(22) Filed: Aug. 23, 2012

(65) Prior Publication Data

US 2014/0056599 A1 Feb. 27, 2014

(51) Int. Cl.
*G03G 15/00* (2006.01)

(52) U.S. Cl.
CPC ..... *G03G 15/55* (2013.01); *G03G 15/5091* (2013.01)
USPC ..... 399/12; 399/122

(58) Field of Classification Search
CPC ..... G03G 15/55; G03G 15/5091; G03G 2215/0695
USPC ..... 399/12, 122
See application file for complete search history.

(56) References Cited

U.S. PATENT DOCUMENTS

2002/0003966 A1* 1/2002 Iwaki et al. ..... 399/12
2010/0098440 A1* 4/2010 Derimiggio ..... 399/12

* cited by examiner

*Primary Examiner* — Benjamin Schmitt
(74) *Attorney, Agent, or Firm* — Ronald E. Prass, Jr.; Prass LLP

(57) ABSTRACT

A system and method are provided for generating and detecting unique identification signatures for customer replaceable components or units (CRUs) for use in customer owned and/or controlled image forming devices. The disclosed systems and methods employ characteristics and circuitry of the CRU itself to avoid sole dependence on the information provided in ac electronically-readable monitoring module to provide security against fraud and to provide compatibility matching. An uncharacteristic operating signature may be introduced in a non-functional zone of an operating parameter including one or more voltage spikes of a specified amplitude and duration. Comparing the voltage spikes to a set of predetermined profiles provides identification for the CRU. A unique automated, machine-readable manner by which to identify a CRU is provided that does not require an externally-readable monitoring module or any other identifying label to be mounted on, or otherwise associated with, the CRU.

14 Claims, 4 Drawing Sheets

SYSTEMS AND METHODS FOR GENERATING AND DETECTING UNIQUE IDENTIFICATION SIGNATURES FOR CUSTOMER REPLACEABLE UNITS IN IMAGE FORMING DEVICES

BACKGROUND

1. Field of the Disclosed Embodiments

This disclosure relates to systems and methods for generating and detecting unique identification signatures for customer replaceable components or units (CRUs) for use in customer owned and/or controlled image forming devices.

2. Related Art

All manner of image forming devices make use of consumable products, such as inks and toners, and otherwise include customer replaceable components or units (CRUs), many of which are routinely replaceable based on a limited service life. In the latter instance, the service life of a particular CRU may be tracked and measured, for example, according to a number of image forming operations that the CRU may undertake. Depending on a level of sophistication in the image forming device, a customer or end-user may be provided feedback regarding a condition of a limited-service-life CRU or a remaining level of consumable in a CRU in the image forming device. Customers and end-users may be provided with alerts to warn them regarding an impending end-of-service-life condition for a CRU, or a pending exhaustion of a particular consumable in a CRU in the image forming device.

Companies that manufacture and sell image forming devices generate substantial post-sale revenue from the separate business of selling, to the customers and end-users to which they have previously sold the image forming devices, replacement CRUs. Based on the significant revenue that may be available in the marketplace for replacement CRUs, whether new, refurbished, refilled or the like, recent years have witnessed a growth in companies whose business is to manufacture, remanufacture, refurbish, refill, or otherwise provide "gray" market replacement CRUs for use in image forming devices. The steep increase in the growth of companies manufacturing and selling "gray" market components adversely affects the companies that manufacture and sell the image forming devices for customers and/or end-users. There are measurable economic effects based on the loss of revenue from the customers and/or end-users purchasing replacement CRUs from sources other than the image forming device manufacturers. More subtle, however, are the intangibles such as the potential for an impact on the reputation of the image forming device manufacturer in instances where specific users experience poor image quality for images produced on a particular image forming device without recognizing that the fault may lie not with the image forming device itself, but rather with the quality of the less than optimally compatible replacement CRUs that have been procured and installed in the image forming device.

The companies that manufacture and sell image forming devices to customers and end-users, therefore, have a significant vested interest in attempting to combat the use of "gray" market replacement CRUs in their image forming devices. The schemes employed by the image forming device manufacturers may include contractual schemes such as specifically warning their customers and/or end-users that the use of non-company manufactured replacement CRUs in a particular image forming device will invalidate any warranty protection on the image forming device. There will remain, however, customers and/or end-users that are willing to accept voiding the warranty as a trade-off for potential cost savings associated with procuring and using "gray" market replacement CRUs.

Industries that manufacture machinery of all types, including companies that manufacture and sell image forming devices, make extensive beneficial use of capabilities to externally monitor operating conditions of myriad CRUs in all manner devices and systems with which the CRUs are associated. The monitoring of these CRUs is often facilitated through the use of externally or remotely electronically-readable monitoring modules for monitoring one or more characteristics of the CRUs. The monitored characteristics can include static information, i.e., information that does not change over the life of the CRU, such as a model or serial number and/or compatibility matching information for the CRU with the system or device within which the CRU is intended to be installed. The monitoring module can also be used to record, in an electronically-readable format, dynamically changing information relating to a particular characteristic of the CRU. Such dynamic information includes, for example, information on use, maintenance, failures, diagnostics, remanufacture, and/or remaining service life, among other characteristics of the CRU.

Outputs from these electronically-readable monitoring modules are received locally at the system or device via module reading components in the device and are often displayed on some manner of graphical user interface (GUI) associated with the system or device within which the CRU is installed. Additionally, outputs of these electronically-readable monitoring modules may be remotely received by, for example, suppliers and manufacturers based on the customer or end-user granting electronic access to the device. In this manner, the manufacturer or supplier can independently monitor the status of a particular CRU in order to provide service and supply replacement CRUs to customers and/or end-users at a point and time of need.

U.S. Pat. No. 6,351,621 to Richards et al. (Richards), which is commonly assigned and the disclosure of which is incorporated herein by reference in its entirety, discloses CRUs, which routinely include electronically-readable monitoring chips containing static information for identification of the CRUs, and/or dynamic information relating to a particular CRU's operating status. Richards refers to such electronically-readable monitoring chips as customer replaceable unit monitors (CRUMs).

Richards explains that, when an individual CRU is installed in the disclosed modularly-designed office equipment, a communication interface is established with the CRUM as a component status monitoring module located within, or externally mounted to, a particular CRU. The CRUM enables the office equipment to monitor a characteristic of the CRU by reading data from, and potentially updating the information contained by writing data to, the monitoring module.

SUMMARY OF THE DISCLOSED EMBODIMENTS

CRUMs are widely employed to attempt to curtail the use of "gray" market components by providing necessary compatibility information that the image forming device must read from the CRUM regarding a newly-installed CRU before it will proceed with further image forming operations after the installation of the CRU. In this manner, the CRUM can be used to address issues of fraud and security. Specifically, the CRUM is a vehicle by which the CRU is made to communicate to the image forming device within which the CRU is installed to provide compatibility information to tell the image forming device that the newly-installed CRU is an authorized or compatible CRU provided by the manufacturer of the image forming device, e.g., a device manufacturer proprietary device rather than a copy or counterfeit device.

Device manufacturers may place CRUMs on CRUs to communicate with the image forming device with in which the CRU is installed to identify itself as an authorized compatible replacement component. Additionally, there may be compatibility issues that the CRUM can be used to confirm. Within a class of CRUs, for example, compatibility of a particular CRU with an image forming device within which the CRU is installed may need to be confirmed in order that installation of a particular CRU achieves the desired results and does not otherwise damage either the image forming device or the CRU when that CRU is installed in a particular image forming device.

Examples of CRUs that may require compatibility matching include fusers for installation in fusing modules in image forming devices. The fuser unit in an image forming device is widely understood to be that module that fuses the deposited toner onto an image receiving medium substrate. The fuser unit typically employs fuser rollers that can be heated to a high temperature to correctly fuse and fix the deposited image material on the image receiving medium substrate. The image receiving medium substrate may, for example, pass between the two heated rollers and the toner heated and fused onto the image receiving medium substrate by a combination of heat and pressure. To accomplish this, the fusers have heater elements embedded inside them, and thermistors or other temperature sensors (which terms will be used interchangeably in this disclosure) to detect temperatures and allow the temperature to be controlled. A CRU fuser, depending on its installation, may have a 110 V rating or 230 V rating that may vary with a geographic location of the image forming device within which the CRU fuser is installed. It is easily recognized that, if one incorrectly installs a 110 V fuser at 230 V machine, there is significant potential for catastrophic damage.

A CRU fuser module may be fitted with a CRUM that can store an encrypted signature that identifies the CRU fuser. These CRUMs are recognizable and have an additional cost associated with them. "Gray" market manufacturers are aware of the CRUMs on CRUs, including CRU fusers and undertake efforts to circumvent the security and compatibility matching that the CRUM may provide.

It would be advantageous to employ characteristics and circuitry of a CRU itself to avoid sole dependence on the information provided in a CRUM to provide security against fraud and compatibility matching.

In CRU fusers, it may be advantageous to apply an uncharacteristic signature to the thermistor temperature response during heating or warm-up profile of the CRU fuser that could be uniquely identified by the image forming device to confirm identification of a particular CRU fuser as one that is authorized for use in, and compatible with, the image forming device within which the CRU fuser is installed. For example, below some cut-off temperature such as, for example, about 100 degrees C., where the temperature of a fuser is not hot enough to be used for fusing, an uncharacteristic signature may be applied that would not affect the fusing performance. The uncharacteristic signature may, however, be detected and used as a method to identify the CRU fuser as a unit manufactured or supplied by the image forming device manufacturer or an authorized supplier, such as a company licensed by the image forming device manufacturer.

It is also recognized that a CRUM may add a certain level of expense to the cost of a CRU with which the CRUM is associated. These costs include the CRUMs themselves, as well as the associated infrastructure within the image forming device to read and interpret the CRUM.

It may be advantageous to provide a system and/or method as a supplement to, or replacement for, CRUMs to provide information regarding security, compatibility, and other aspects of the CRU with respect to the image forming device within which the CRU is installed.

Exemplary embodiments of the systems and methods according to this disclosure may provide a unique automated, machine-readable manner by which to identify a CRU in a manner that does not require an externally-readable monitoring module or any other identifying label to be mounted on, or otherwise associated with, the CRU.

Exemplary embodiments may replace or supplement the identification capabilities that are currently provided by externally-readable monitoring modules such as, for example, CRUMs.

Exemplary embodiments may provide operational programming of a CRU that is less detectable than the presence of an externally-readable monitoring module, such as a CRUM, associated with the CRU.

Exemplary embodiments may make use of non-functional operating zones in an electrical profile of a CRU such as, for example, a warm-up process for a CRU fuser, to specify a particular machine-readable profile that uniquely identifies the CRU to the image forming device within which the CRU is installed.

Exemplary embodiments may make particularly advantageous use of the composition of a CRU fuser including multiple electrically-energized heater elements, and multiple temperature sensors, to generate a unique voltage profile to the heater elements that can be monitored by the temperature sensors to determine whether a heating profile of a newly-installed CRU fuser coincides with the one or more expected heating profiles programmed into the image forming device. Fusing units, such as CRU fusers, necessarily comprise heater elements and temperature sensor components. As such, the systems and methods according to this disclosure make advantageous use of necessarily-installed components without adding additional components, for example, to the CRU fuser.

Exemplary embodiments may employ a unique profile for a characteristic parameter of a CRU to uniquely identify that CRU to the image forming device within which the CRU is installed in an effort to ensure compatibility, avoid fraud, and/or otherwise benefit the customer or end-user.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for generating and detecting unique identification signatures for CRUs for use in customer owned and/or controlled image forming devices, will be described, in detail, with reference to the following drawings, in which.

DETAILED DESCRIPTION OF THE DISCLOSED EMBODIMENTS

The systems and methods for generating and detecting unique identification signatures for customer replaceable components or units (CRUs), and particularly for CRU fusers, for use in customer owned and/or controlled image forming devices according to this disclosure will generally refer to this specific utility for those systems and methods. Exemplary embodiments described and depicted in this disclosure should not be interpreted as being specifically limited to any particular configuration, or directed to any particular intended use. In fact, any advantageous use of a specific component operating profile for a replaceable component in a machine that may be generated and/or monitored by the machine in support of compatibility matching and security according to this disclosure is contemplated.

Specific reference to, for example, any particular image forming device, including but not limited to any of a printer, copier, scanner, facsimile machine or multi-function device, particularly those including toner-based image forming and/or fusing modules, should be understood as being exemplary only, and not limited, in any manner, to any particular class of such devices. The systems and methods according to this disclosure will be described as being particularly adaptable to use in printing and/or copying devices such as, for example, xerographic image forming devices for printing and/or copying that employ heated fuser units and/or fusing modules for fusing toner images on image receiving medium substrates, but should not be considered as being limited to only these types of devices. Any commonly known image forming device capable of controlling an operating profile of an installed CRU in a manner that may produce a uniquely responsive profile, particularly in a non-functional operating range for the CRU, that may be adapted according to the specific capabilities discussed in this disclosure is contemplated.

Figure 1:
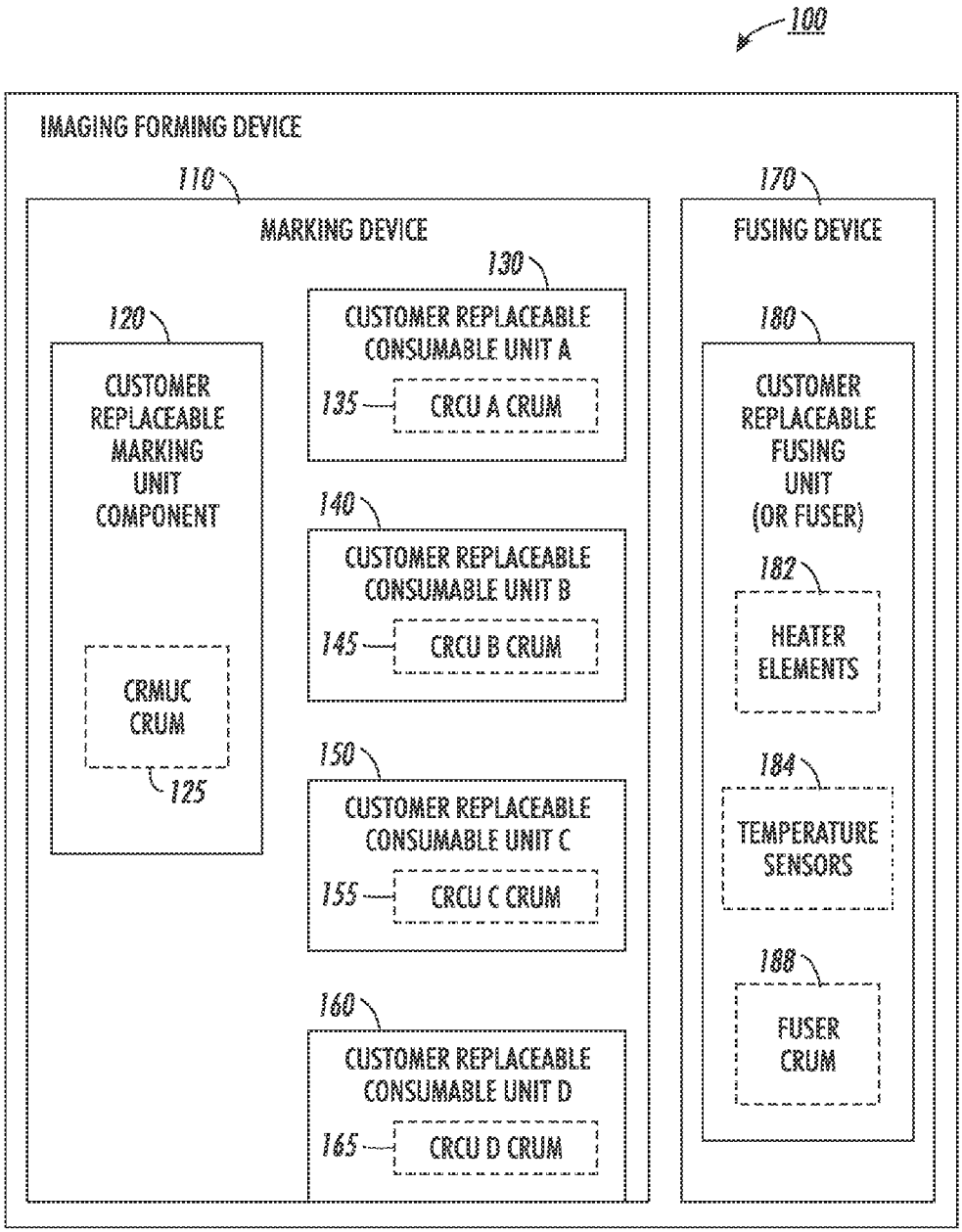
FIG. 1 illustrates a simplified schematic diagram of an exemplary image forming device implementing a CRUM-based communication scheme between a plurality of CRUs and the image forming device.

FIG. 1 illustrates a simplified schematic diagram of an exemplary image forming device 100 implementing a CRUM-based communication scheme between a plurality of CRUs and the image forming device. As shown in FIG. 1, the exemplary image forming device 100 may include at least one marking device 110 for marking an image receiving medium substrate with image marking material and at least one fusing device 170 for fusing the image marking material onto the image receiving medium substrate to fix an image thereon.

The at least one marking device 110 may include at least customer replaceable marking unit component 120. The customer replaceable marking unit component 120 may be, for example, a photoreceptor drum, or belt, or other like device that may have a limited service life, which is intended to be replaced by the customer with a replacement authorized and compatible component supplied by the image forming device manufacturer at an end of the service life for the component. The end of service life may be, for example, after a predetermined number of image forming cycles. The customer replaceable marking unit component (CRMUC) 120 may include a CRMUC monitoring module (CRMUC CRUM) 125. The CRMUC CRUM 125 may include static and dynamic information, as discussed above, that is communicated to, received from, or exchanged with information exchange components (not shown) in the image forming device. The information exchange scheme between the image forming device and the CRMUC CRUM 125, and other CRUMs depicted and described in this disclosure, will be according to known methods, such as those described in Richards, and will not be further described.

The at least one marking device 110 may include a plurality of customer replaceable consumable units A-D 130,140,150,160. The plurality of customer replaceable consumable units A-D 130,140,150,160 may be, for example, a plurality of different color toner bottles whose utility is measured according to the expenditure of the individually-colored toner in each toner bottle. Once the consumable in each of the plurality of customer replaceable consumable units A-D 130,140,150,160 is expended, each of the plurality of customer replaceable consumable units 130,140,150,160 A-D is intended to be replaced by the customer with a replacement authorized and compatible consumable unit supplied by the image forming device manufacturer. The plurality of customer replaceable consumable units (CRCUs) A-D 130,140,150,160 may include a plurality of respective CRCU A-D monitoring modules (CRCU A-D CRUMs) 135,145,155,165. The CRCU CRUMs 135,145,155,165 may include static and dynamic information, as discussed above, that is communicated to, received from, or exchanged with the information exchange components (not shown) in the image forming device. Specifically, the information exchange scheme may be used to monitor a current level, and/or pending exhaustion, of a particular consumable.

The at least one fusing device 170 may include at least one customer replaceable fusing unit (or fuser) 180. The fuser 180 may be, for example, a roller or like device that includes heater elements 182 to which a voltage is applied by the image forming device 100 to heat the fuser 180, and temperature sensors 184 to provide feedback to control the heating of the fuser 180 according to a specific profile to operating temperatures within a specified operating temperature range. Like the customer replaceable marking unit component 120, the fuser 180 may have a limited service life. The fuser 180 is also intended to be replaced by the customer with a replacement authorized and compatible fuser supplied by the image forming device manufacturer at an end of the service life for the fuser 180. The end of service life may be, for example, after a predetermined number of heating cycles for the fuser 180. The fuser 180 may include a fuser monitoring module (fuser CRUM) 188. The fuser CRUM 188 may include static and dynamic information, as discussed above that is communicated to, received from, or exchanged with information exchange components (not shown) in the image forming device.

Figure 2:
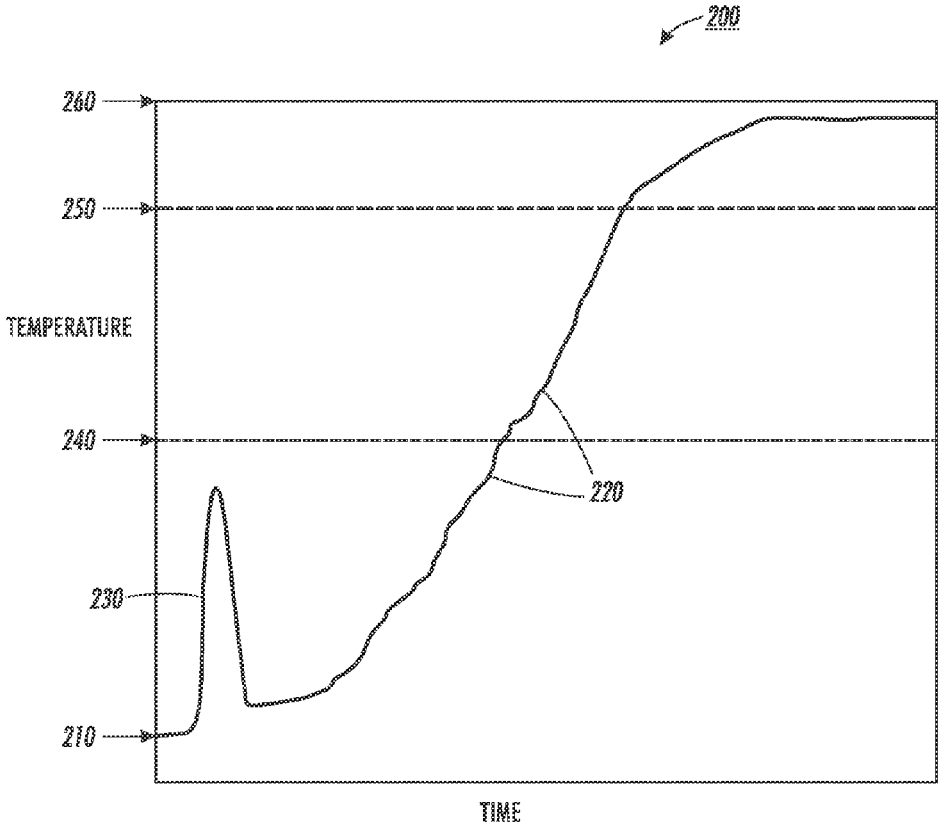
FIG. 2 illustrates an exemplary embodiment of a heating profile for a CRU fuser that may be used to uniquely identify the CRU fuser to the image forming device within which the CRU fuser is installed according to this disclosure.

FIG. 2 illustrates an exemplary embodiment of a heating profile 200 for a CRU fuser that may be used to uniquely identify the CRU fuser to the image forming device within which the CRU fuser is installed according to this disclosure. The heating profile 200 may be typically specified according to a temperature increasing profile portion 220 from an ambient temperature 210 to an optimal operating range between a minimum acceptable fusing temperature 250 and a maximum acceptable fusing temperature 260. At temperatures below the minimum acceptable fusing temperature 250, the image marking material, and consequently the image, will not be properly fused and fixed onto the image receiving medium substrate. At temperatures above the maximum acceptable fusing temperature 260, damage to the fuser 180, the image and/or the image receiving medium substrate may occur through overheating.

The systems and methods according to this disclosure may specify a cut-off temperature 240 below which modifications to the temperature increasing profile portion 220 may be undertaken by schemes according to this disclosure, and above which the final phase of the temperature increasing profile portion 220 of the heating profile 200 for the CRU fuser may proceed unmodified. In the range of temperatures below the specified cut-off temperature 240, and above ambient temperature, the heater elements and temperature sensors of the CRU fuser may, in concert with a connected circuit, cause one or more temperature (voltage) spikes 230 of a specified amplitude and duration to be introduced. The one or more temperature (voltage) spikes 230, with specifically-defined amplitudes and durations, may represent a unique pattern that may identify the CRU fuser to the image forming device within which the CRU fuser is installed. The image forming device may be programmed in a manner that reads the variations in the temperature increasing profile portion 220 of the heating profile 200 of the CRU fuser and compares this portion to stored information regarding a heating profile that is expected to be exhibited by an authorized and compatible CRU fuser. In this manner, the image forming device may be able to uniquely identify a newly-installed CRU fuser as one that is compatible with the image forming device and otherwise authorized for use in the image forming device. Image forming devices may be programmed with a plurality of such heating profiles in order that CRU fusers may be programmed with one or more of the plurality of profiles in an effort to enhance an ability to identify compatibility between the CRU fuser and the image forming device in a manner that promotes contract compliance, security and anti-fraud aimed at reducing, for example, a frequency of use of "gray" market products as potentially inferior replacements for the authorized and compatible CRU fusers in the image forming devices.

It should be recognized that the programming built into non-operational portions of an operating parameter scheme such as, for example, in the heating profile for a fuser, may be undetectable thereby enhancing security. It is anticipated that characteristics of the operating parameter may be subtly modified in the manner discussed in this disclosure such that "gray" market competitors will be unable to easily detect and reproduce the particular profile for the fuser, thereby decreasing any attractiveness to, or economic benefit to be gained from, the use of such "gray" market components.

An advantage of the systems and methods according to this disclosure to replace or supplement the use of externally-readable monitoring modules, such as CRUMs, is that the presence of the disclosed security, anti-fraud and compatibility monitoring features does not require the attachment of an additional security, anti-fraud or monitoring device to a CRU, such as a CRU fuser.

This does not necessarily imply that the use of the systems and methods according to this disclosure has significant advantage over CRUM-based security features. Rather, it should be understood that some combination of the disclosed security features with other currently available security and/or anti-fraud features may aid in increasing a difficulty in making "gray" market customer replaceable components uniquely compatible with the image forming devices within which they are intended to be installed thereby decreasing the attractiveness of the use of such components.

In practice, during a heating profile of a fuser module, once the temperature of the fuser module reaches some threshold above, and discernible from, ambient temperature, the profile may be subject to a voltage spike that is removable at some interval later once the fuser has heated up by another separate predetermined and discernible amount. In this manner, a normal generally linear profile for the heating cycle of, for example, the fuser may be modified in a manner that is programmed and predictable.

A simple electrical or electronic circuit may be added below an outer layer of a fuser, for example, that operates in conjunction with the heaters and temperature sensors in the fuser to provide the variable heating profile for the fuser. The simple electrical or electronic circuit may be, for example, potted in a silver resin in the fuser to further conceal its presence. Embedding the circuit in the customer replaceable component in a manner that comports with a general configuration of the customer replaceable component may further enhance the security afforded by the systems and methods according to this disclosure in that potential counterfeiters may be unable to reasonably detect the presence or the configuration of the components.

Again here, it should be noted that any customer replaceable component that includes electrical operating parameters, may be modified in a like manner according the systems and methods of this disclosure to present a specific electrical profile with regard to, for example, voltage applied to the customer replaceable component via a specified circuit, that may render a unique profile in a non-operating region and/or mode of the customer replaceable component. In this manner, the systems and methods according to this disclosure, although described as being particularly adaptable to fuser modules, are not intended to be limited to such modules.

Benefits of the disclosed schemes may include that multiple signature variations can be applied to form a simple code thus making it possible to apply different codes. Parameters that may be varied may include a number of spikes, a temperature or temperatures at which spike(s) occur, a duration of the spike(s), and an amplitude of the spike(s).

Figure 3:
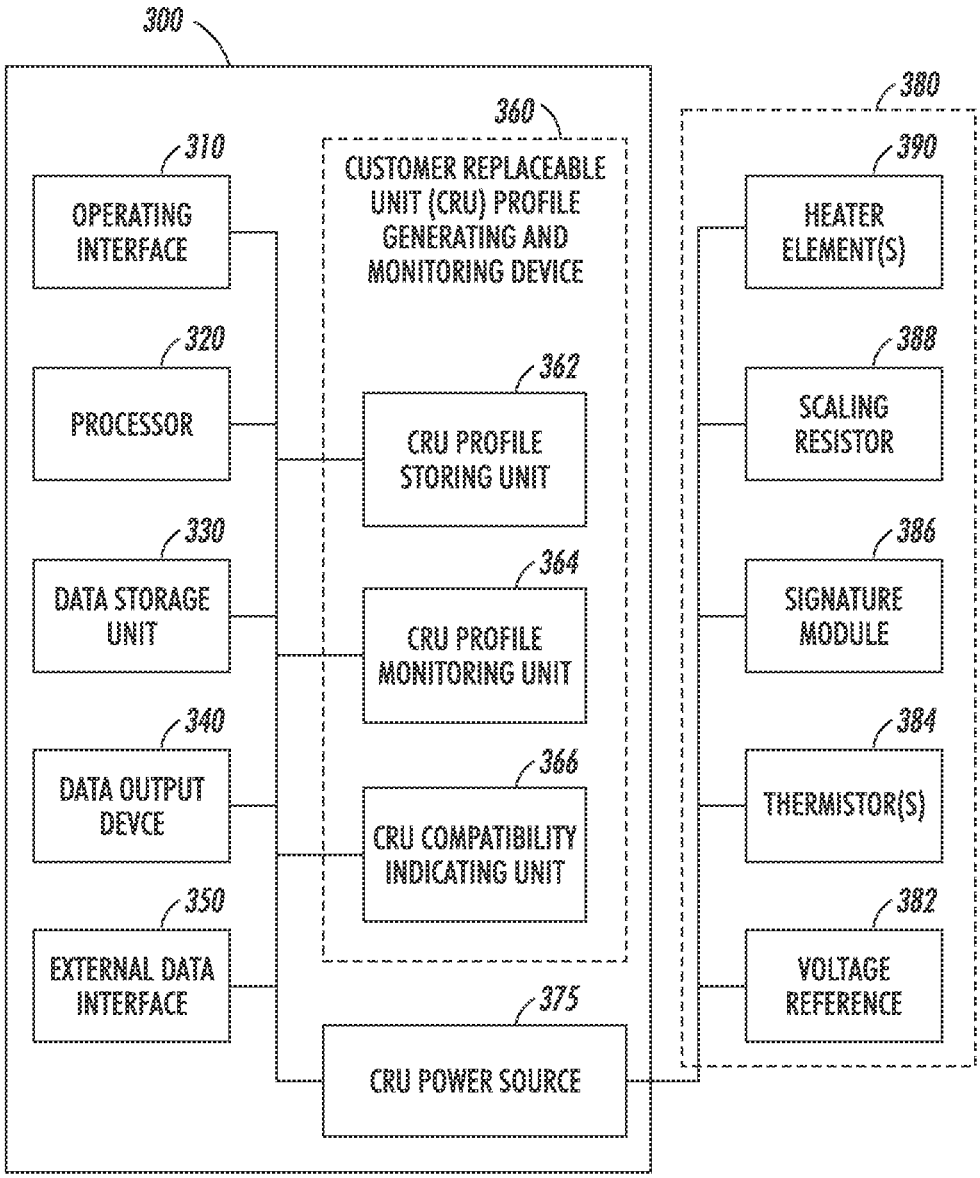
FIG. 3 illustrates a block diagram of an exemplary control system in, or associated with, an image forming device including modules for generating and detecting a unique identification signature for a CRU in a simplified CRU circuit in the image forming device according to this disclosure.

FIG. 3 illustrates a block diagram of an exemplary control system 300 in, or associated with, an image forming device including modules for generating and detecting a unique identification signature for a CRU in a simplified CRU circuit in the image forming device according to this disclosure.

The exemplary control system 300 may include an operating interface 310 by which a user may communicate with the exemplary control system 300. The operating interface 310 may be a locally accessible user interface associated with the image forming device. The operating interface 310 may be configured as one or more conventional mechanisms common to computing devices that permit a user to input information to the exemplary control system 300. The operating interface 310 may include, for example, a conventional keyboard, a touchscreen with "soft" buttons or with various components for use with a compatible stylus, a microphone by which a user may provide oral commands to the exemplary control system 300 to be "translated" by a voice recognition program, or other like device by which a user may communicate specific operating instructions to the exemplary control system 300.

The exemplary control system 300 may include one or more local processors 320 for individually operating the exemplary control system 300 and for carrying out operating functions of the image forming device, including modifying and/or monitoring non-functional operating profiles for CRUs in the image forming device. Processor(s) 320 may include at least one conventional processor or microprocessor that interprets and executes instructions to direct specific functioning of the control system 300. Processor(s) 320 may initiate and control of the operating profile for one or more CRUs, and may monitor a response of the CRU, while additionally or otherwise interacting with any CRUM that may be associated with a particular CRU.

The exemplary control system 300 may include one or more data storage devices 330. Such data storage device(s) 330 may be used to store data or operating programs to be used by the exemplary control system 300, and specifically the processor(s) 320. Data storage device(s) 330 may be used to collect information regarding any or all of the operating profiles that may be associated with authorized and/or compatible CRUs for use in the image forming device that may provide a predetermined set of profiles for comparing a response of a particular CRU to generated inputs. The data storage device(s) 330 may include a random access memory (RAM) or another type of dynamic storage device that is capable of storing updatable database information, and for separately storing instructions for execution of system operations by, for example, processor(s) 320. Data storage device(s) 330 may also include a read-only memory (ROM), which may include a conventional ROM device or another type of static storage device that stores static information and instructions for processor(s) 320. Further, the data storage device(s) 330 may be integral to the exemplary control system 300, or may be provided external to, and in wired or wireless communication with, the exemplary control system 300.

The exemplary control system 300 may include at least one data output device 340 which may be configured as one or more conventional mechanisms that output information to a user, including a display screen on a GUI of the image forming device or on a computing device.

The exemplary control system 300 may include one or more separate external data interfaces 350 by which the exemplary control system 300 may communicate with components external to the exemplary control system 300. At least one of the external data interfaces 350 may be configured as an output port for connection to, for example, a separate printer, a copier, a scanner, a multi-function device, or a remote storage medium, such as a digital memory in any form. Any suitable data connection in wired or wireless communication with an external data repository or external data storage device is contemplated to be encompassed by the external data interface 350.

The exemplary control system 300 may include a specific customer replaceable unit (CRU) profile generating and monitoring device 360 as a part of a processor 320 coupled to, for example, one or more storage devices 330, or as a separate component module or circuit in the exemplary control system 300. The CRU profile generating and monitoring device 360 may include at least a CRU profile storing unit 362, a CRU profile monitoring unit 364 and a CRU compatibility indicating unit 366. Via these separate units, the CRU profile generating and monitoring device 360 of the exemplary control system 300 may execute profile generating, monitoring, and indicting functions to identify a particular CRU, ensure compatibility of the identified particular CRU with the image forming device, and to specifically alert users and others of CRU compatibility or incompatibility.

The CRU profile storing unit 362 may be used to store a plurality of operating profiles for one or unit CRUs for use in the image forming device. These profiles may be pre-stored at a point of manufacture or may be provided to the image forming device periodically with updates, for example to a non-volatile memory (NVM) in the CRU profile storing unit 362. It should be recognized that the CRU profile storing unit may be a separate storage unit or may comprise a portion of at least one of the data storage devices 330.

The CRU profile monitoring unit 364 may monitor a response of a particular CRU to an applied voltage. Based on a simple circuit in the CRU, as will be described in exemplary manner below, the CRU may exhibit a unique signature in response to an applied voltage. Such a unique signature may comprise one or more voltage spikes, for example, in a non-functional operating range for the CRU such as a heating profile for a fuser in a range of temperatures below an operating temperature for the fuser. The CRU profile monitoring unit 364 may monitor the electrical response of the CRU according to known methods.

The CRU compatibility indicating unit 366 may compare monitored CRU profile information with stored CRU profile information to identify individual instances of compatibility or non-compatibility between a particular CRU and the image forming device. In instances where the comparison determines that the CRU is compatible and authorized for use in the image forming device, the CRU compatibility indicating unit 366 may provide an indication to the customer or end-user via the data output device 340. In instances where the CRU is determined, via the comparison, to be incompatible or unauthorized, the CRU compatibility indicating unit 366 may provide an indication to the customer or end-user as well, as a form of warning regarding the incompatibility, or otherwise, unauthorized nature, of the CRU. The CRU compatibility indicating unit 366 may also execute, via the processor, or as a stand-alone component, a routine that prevents image forming operations in the image forming device based on the detected incompatibility or unauthorized nature of the CRU.

The exemplary control system 300 may include a simple circuit 380 in the CRU to which power is introduced from a CRU power source is translated into a voltage reference 382, that generates a unique profile including one of more voltage spikes in non-functional operating ranges for the CRU, as discussed above. The simple circuit 380 may be of virtually any configuration in which a linear response, for example, in a warm-up cycle for the CRU may be modified to include voltage spiking. The simple circuit 380 shown in FIG. 3 may be that associated with a CRU fuser and may include a plurality of thermistors 384, a signature module 386, one or more scaling resistors 388, and a plurality of heater elements 390.

All of the various components of the exemplary control system 300, as depicted in FIG. 3, may be connected by one or more data/control busses 370. These data/control busses 370 may provide wired or wireless communication between the various components of the exemplary control system 300, whether all of those components are housed integrally in, or are otherwise external and connected to an image forming device with which the exemplary control system 300 may be associated. It should be recognized that at least the elements of the simple circuit 380, as depicted in FIG. 3, and as noted above, are intended to be associated with a CRU with which the other components of control system 300 in the image forming device establish wired or wireless communication to complete the exemplary control system 300.

It should be appreciated that, although depicted in FIG. 3 as an integral unit, the various disclosed elements of the exemplary control system 300 may be arranged in any combination of sub-systems as individual components or combinations of components, integral to a single unit, or external to, and in wired or wireless communication with the single unit of the exemplary control system 300. In other words, no specific configuration as an integral unit or as a support unit is to be implied by the depiction in FIG. 3. Further, although depicted as individual units for ease of understanding of the details provided in this disclosure regarding the exemplary control system 300, it should be understood that the described functions of any of the individually-depicted components may be undertaken, for example, by one or more processors 320 connected to, and in communication with, one or more data storage devices 330.

Figure 4:
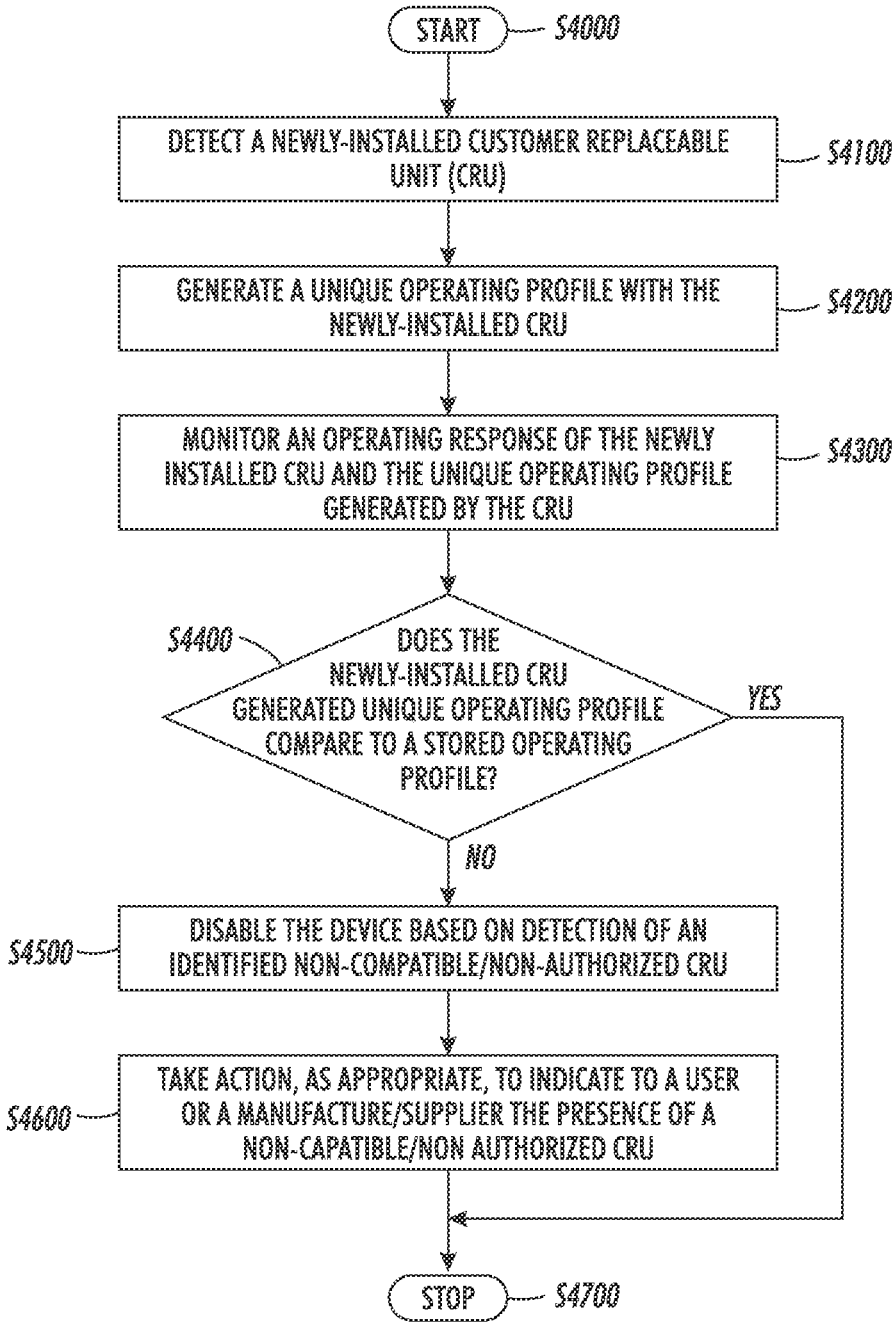
FIG. 4 illustrates a flowchart of an exemplary method for generating and detecting a unique identification signature for a CRU for use in customer owned and/or controlled image forming device according to this disclosure.

The disclosed embodiments may include a method for generating and detecting unique identification signatures for CRUs for use in customer owned and/or controlled image forming devices. FIG. 4 illustrates a flowchart of an exemplary method for generating and detecting a unique identification signature for a CRU. As shown in FIG. 4, operation of the method commences at Step S4000 and proceeds to Step S4100.

In Step S4100, the image forming device may detect a newly-installed CRU. This step may prevent a need to monitor a profile of a CRU every time that the image forming device is turned on or prior to every image forming operation. It is recognized that the response of the CRU should be the same every time it is "warmed up." As such, the response of the CRU could be monitored as part of a start-up routine before every operation. At least, the image forming device should execute the method whenever a monitorable CRU is installed to confirm that it is a compatible and authorized CRU prior to executing any image forming operation involving the CRU. Operation of the method proceeds to Step S4200.

In Step S4200, in response, for example, to an applied voltage, a circuit in the CRU may generate a unique response signature. This unique response signature may be returned while the CRU is in a non-operating mode, such as during a heating profile for a CRU fuser prior to the CRU fuser achieving its preferred operating temperature range. The unique signature may be in the form of one or more voltage spikes according to a specified pattern of amplitudes and durations, which may be viewed by monitoring components in the image forming device as a unique operating profile. Operation of the method proceeds to Step S4300.

In Step S4300, components in the image forming device monitor the operating response of the CRU, and specifically, the unique signature elements generated by the CRU in response, for example, to a voltage reference signal sent to the CRU from the image forming device. Operation of the method proceeds to Step S4400.

Step S4400 is a determination step. In Step S4400, a determination is made whether a monitored operating response of the CRU as a unique signature for the CRU matches one or more of a plurality of signature profiles stored in the image forming device.

If, in Step S4400, it is determined that the unique signature of the CRU matches one or more of the plurality of signature profiles stored in the image forming device, operation of the method proceeds to Step S4700, where operation of the method ceases. The CRU will, in this manner, have been determined to be compatible with, and/or authorized for use in, the image forming device and image forming operations will be allowed to proceed unimpeded. The image forming device may provide some feedback to the customer and/or end-user, and to a manufacturer/supplier, when connected to the image forming device, of the confirmation of the compatibility and authorization based on the compared profile data.

If, in Step S4400, it is determined that the unique signature of the CRU does not match any of the plurality of signature profiles stored in the image forming device, operation of the method proceeds to Step S4500, In Step S4500, image forming operations may be interrupted based on the detected presence of an incompatible and/or unauthorized CRU. Corrective action on the part of the customer or end-user may be required to correct the situation before an automatically disabled image forming device may be enabled to proceed with image forming operations. This corrective action will preferably include replacing the "questionable" CRU with one that is known to be compatible and authorized based on its having been supplied as a certified replacement unit by the image forming device manufacturer. Operation the method proceeds to Step S4600.

In Step S4600, feedback, in the form of warning messages on a display of the image forming devices or via external communication signals generated by the image forming device, may be provided to the customer and/or end-user, and to a manufacturer/supplier, when connected to the image forming device, of the attempted operation of the image forming device with an incompatible or unauthorized CRU in order that appropriate action may be initiated. Response scenarios will likely differ depending on the contractual relationships and obligations between the image forming device manufacturer and the customer or end-user. Operation of the method proceeds to Step S4700, where operation of the method ceases.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and image processing environments in which the subject matter of this disclosure may be implemented for familiarity and ease of understanding. Although not required, embodiments of the disclosure may be provided, at least in part, in a form of hardware circuits, firmware, or software computer-executable instructions to carry out the specific functions described. These may include individual program modules executed by a processor. Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in image forming devices and other customer-controlled machinery and systems that may include CRUs of many different configurations. Embodiments according to this disclosure may be practiced in distributed computing environments where tasks are performed by local and remote devices that may, for example, remotely direct image forming operations in a particular image forming device and receive messages regarding the progress of the directed image forming operations. Remotely-located devices and components may be linked to each other by hardwired links, wireless links, or a combination of both through a communication network. In a distributed computing environment, program modules may be located in both local and remote memory storage devices.

As indicated above, embodiments within the scope of this disclosure may also include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or another communications connection, whether wired, wireless, or in some combination of the two, the receiving processor properly views the connection as a computer-readable medium. Thus, any such connection is properly termed a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps. The exemplary depicted steps may be executed in any reasonable order to effect the objectives of the disclosed embodiments. No particular order to the disclosed steps of the method is necessarily implied by the depiction in FIG. 4, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure. For example, the principles of the disclosure may be applied to each individual printing device of a plurality of printing devices where each printing device may include some portion of the disclosed system and execute some portion of the disclosed method.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

I claim:

1. A method of identifying a customer replaceable component, comprising:

energizing the customer replaceable component;

monitoring, with a processor, a response profile of the customer replaceable component to an applied voltage;

comparing, with the processor, the monitored response profile of the customer replaceable component to one or more expected response profiles for the customer replaceable component;

identifying whether the customer replaceable component is at least one of a compatible and an authorized customer replaceable component based on the comparison; and outputting a result of the identifying to a user, the monitoring comprising detecting one or more voltage spikes in the monitored response profile for the customer replaceable component;

the customer replaceable component being a fuser unit in an image forming device, and the one or more voltage spikes occurring during a heating profile for the fuser unit at temperatures below a predetermined threshold temperature; and the predetermined threshold temperature being a temperature in a range above an ambient temperature for an operating environment of the fuser unit and below a minimum acceptable operating temperature for fusing operations using the fuser unit.

2. The method of claim 1, the one or more voltage spikes being of at least one of a predetermined number of voltage spikes, of predetermined amplitudes and of predetermined durations.

3. The method of claim 1, the one or more expected response profiles for the customer replaceable component being stored in a data storage device, the processor recovering the one or more expected response profiles for the customer replaceable component from the data storage device for the comparing.

4. The method of claim 3, the one or more expected response profiles for the customer replaceable component being at least one of stored in the data storage device prior to delivery of a system to a customer and updated over an operating life of the system as customer replaceable component configurations change.

5. The method of claim 1, the processor being in an image forming device in which the customer replaceable component is used, the method further comprising disabling the image forming device if the identifying determines that the customer replaceable components is at least one of not compatible with and unauthorized for use in the image forming device.

6. The method of claim 5, the processor generating a warning message to indicate to at least one of a customer using the image forming device and a manufacturer or supplier of the image forming device that is in communication with the image forming device of a presence of an identified incompatible or unauthorized customer replaceable component in the image forming device.

7. A system for identifying a customer replaceable component, comprising:

a power source that energizes the customer replaceable component;

a monitoring device that monitors a response profile of the customer replaceable component to an applied voltage;

a comparing device that compares the monitored response profile for the customer replaceable component to one or more expected response profiles for the customer replaceable component;

an identifying device that identifies whether the customer replaceable component is at least one of a compatible and an authorized customer replaceable component based on the comparison; and a data output device that outputs a result of the identifying to a user in a form usable by the user, the monitoring comprising detecting one or more voltage spikes in the monitored response profile for the customer replaceable component;

the customer replaceable component being a fuser unit in an image forming device, and the one or more voltage spikes occurring during a heating profile for the fuser unit at temperatures below a predetermined threshold temperature; and the predetermined threshold temperature being a temperature in a range above an ambient temperature for an operating environment of the fuser unit and below a minimum acceptable operating temperature for fusing operations using the fuser unit.

8. The system of claim 7, the one or more voltage spikes in the monitored response profile being generated by a circuit in the customer replaceable component.

9. The system of claim 7, the one or more voltage spikes being of at least one of a predetermined number of voltage spikes, of predetermined amplitudes and of predetermined durations.

10. The system of claim 7, further comprising a data storage device that stores the one or more expected response profiles for the customer replaceable component, the comparing device recovering the one or more expected response profiles for the customer replaceable component from the data storage device for the comparing.

11. The system of claim 10, the one or more expected response profiles for the customer replaceable component being at least one of stored in the data storage device prior to delivery of a device including the system to a customer and updated over an operating life of the device as customer replaceable component configurations change.

12. The system of claim 7, the system being associated with an image forming device in which the customer replaceable component is used, the system further comprising a disabling device that disables the image forming device if the identifying device identifies that the customer replaceable component is at least one of not compatible with and unauthorized for use in the image forming device.

13. The system of claim 12, the disabling device generating a warning message to indicate to at least one of a customer using the image forming device and a manufacturer or supplier of the image forming device that is in communication with the image forming device of a presence of an identified incompatible or unauthorized customer replaceable component in the image forming device.

14. A non-transitory computer-readable medium storing instructions which, when executed by a processor, cause the processor to execute the steps of a method for identifying a customer replaceable component comprising:

energizing the customer replaceable component;

monitoring a response profile of the customer replaceable component to an applied voltage;

comparing the monitored response profile for the customer replaceable component to one or more expected response profiles for the customer replaceable component;

identifying whether the customer replaceable component is at least one of a compatible and an authorized customer replaceable component based on the comparison; and outputting a result of the identifying to a user, the monitoring comprising detecting one or more voltage spikes in the monitored response profile for the customer replaceable component, and the customer replaceable component being a fuser unit in an image forming device, the one or more voltage spikes occurring during a heating profile for the fuser unit at temperatures below a predetermined threshold temperature; and the predetermined threshold temperature being a temperature in a range above an ambient temperature for an operating environment of the fuser unit and below a minimum acceptable operating temperature for fusing operations using the fuser unit.

* * * * *